US006986207B2

(12) United States Patent
Selek

(10) Patent No.: US 6,986,207 B2
(45) Date of Patent: Jan. 17, 2006

(54) SINGLE-USE DISPOSABLE SHAVING SET

(76) Inventor: Ali Saban Selek, BA6DAT CAD 217-A-10, Idealtepe, Istanbul (TR) 80380

( * ) Notice: Subject to any disclaimer, the term of this patent is extended or adjusted under 35 U.S.C. 154(b) by 0 days.

(21) Appl. No.: 10/248,510

(22) Filed: Jan. 24, 2003

(65) Prior Publication Data

US 2004/0143977 A1 Jul. 29, 2004

(51) Int. Cl.
*B26B 21/44* (2006.01)

(52) U.S. Cl. ..... 30/41; 30/526; 30/535; 132/289

(58) Field of Classification Search ..... 30/41, 30/41.5, 47, 526, 535, 537, 538; 132/289, 132/290, 291, 292
See application file for complete search history.

(56) References Cited

U.S. PATENT DOCUMENTS

| | | | | | |
|---|---|---|---|---|---|
| 3,417,468 | A | * | 12/1968 | Miyauchi | 30/41 |
| 4,023,269 | A | * | 5/1977 | Lopez, Jr. | 30/41 |
| 4,077,119 | A | * | 3/1978 | Sellera | 30/41 |
| 4,129,942 | A | * | 12/1978 | Denizman | 30/41 |
| 4,433,483 | A | * | 2/1984 | Lazarus | 30/41 |
| 4,791,723 | A | * | 12/1988 | Jacobson | 30/41 |
| 4,908,945 | A | * | 3/1990 | Jacobson | 30/41 |
| 4,954,337 | A | * | 9/1990 | Gripp et al. | 424/73 |
| 4,974,319 | A | * | 12/1990 | Maguire et al. | 30/41 |
| 5,016,351 | A | * | 5/1991 | Drahus | 30/41 |
| 5,018,543 | A | * | 5/1991 | Trillo Martinez et al. | 132/289 X |
| 5,070,611 | A | * | 12/1991 | Derin et al. | 30/41 |
| 5,092,041 | A | * | 3/1992 | Podolsky | 30/41 |
| 5,103,560 | A | * | 4/1992 | Podolsky | 30/41 |
| 5,133,130 | A | * | 7/1992 | Podolsky | 30/41 |
| 5,141,349 | A | * | 8/1992 | Maguire et al. | 30/41 X |
| 5,168,628 | A | * | 12/1992 | Mock et al. | 30/41 |
| 5,269,062 | A | * | 12/1993 | Dallaire et al. | 30/41 |
| 5,337,478 | A | * | 8/1994 | Cohen et al. | 30/41.5 |
| 5,673,485 | A | * | 10/1997 | Hill | 30/41.5 |
| 5,701,674 | A | * | 12/1997 | Mitchell | 30/41 |
| 5,725,483 | A | * | 3/1998 | Podolsky | 601/15 |
| 5,761,813 | A | * | 6/1998 | Frick et al. | 30/41 |
| 5,855,066 | A | * | 1/1999 | Manger | 30/41 |
| 6,754,958 | B2 | * | 6/2004 | Haws et al. | 30/41 |
| 6,789,321 | B2 | * | 9/2004 | Simms | 30/41 |

FOREIGN PATENT DOCUMENTS

| | | | |
|---|---|---|---|
| WO | WO 97/18065 | * | 5/1997 |

* cited by examiner

*Primary Examiner*—Clark F. Dexter
(74) *Attorney, Agent, or Firm*—Collen IP; Donald J. Ranft

(57) ABSTRACT

A single-use disposable shaving set composed of three pieces; first piece being a shaving foam cartridge containing pressurized shaving foam sufficient for a single shave, second piece being an aftershave liquid cartridge containing a kind of after shave liquid sufficient for a single shave, and the third piece being a blade assembly having at least a blade coupled thereto; all three of the pieces contained in a wrapped box slightly bigger than a standard matchbox without being mounted in order to occupy the smallest space possible, under a hygienic condition; the foam cartridge and the aftershave liquid cartridge forming the handle of a shaving machine when mounted together and all forming a shaving machine when the blade assembly is mounted to the handle; the set featuring all the minimum requirements of a well wet shave; the entire set to be disposed off after a single use.

12 Claims, 5 Drawing Sheets

SINGLE-USE DISPOSABLE SHAVING SET

BACKGROUND OF INVENTION

One of the most significant problems encountered by traveling men is carrying the shaving set. Particularly in voyages confined to overnight, finding a suitable place for the shaving set poses a real dilemma.

Although most of the hotels equip their rooms with soap, shampoo and, at times tooth-paste and brush, hair-combs and even perfume, hardly any hotel managements ponder to provide shaving sets. One of the foremost pretexts for their failure is probably the cost-factor since a shaving-machine alone appears of no functional use, requiring the addition of shaving cream and/or foam and shaving-lotion as accompaniments.

Presumably stimulated by such necessities, inventors have devised and formulated various solutions to the predicament, up today. Known prior art disposable razors invented particularly to meet the needs of travelers include U.S. Pat. No. 4,129,942 of Denizman; U.S. Pat. Nos. 4,791,723 and 4,908,945 of Jacobson; U.S. Pat. No. 5,855,066 of Menger and WO Pat. No. 97/18065 of Kim.

In the same context, although primarily aimed at facilitating usage by the travelers, our invention is fraught with unique characteristics, distinctly different from its comparables. In a way that:

a) The invention is composed of three basic parts and at the preliminary phase, these parts are placed in a box, in a de-mounted format; turning into a shaving-machine when mounted.

b) The invention is structured to contain both shaving foam and after-shave liquid, the major prerequisites of a well wet shave.

c) The box that contains the three parts is an integral and complementary piece of the invention itself, just like the containers of the audiocassettes and CDs.

d) The dimensions of the box are slightly larger than a standard matchbox. In that regard, it occupies considerably less spaces and can be conveniently carried along to any place. In fact, the underlying reason for presenting the shaving-machine's components in a demounted form and inserting them into a box is that the invention is intended to take less space and transported with comfort and ease. The sizes of each item are designed and adjusted so that the box's aggregates are maintained intact and at a minimum dimension.

e) The box is wrapped by gelatin and/or a corresponding substance; owing to this determinant, all of the parts inside are to be construed as extremely hygienic.

f) The invention is solely for single use. This aspect also reinforces its hygienic supremacy.

In contrast, the other inventions:

a) May be utilized more than once.

b) They resemble the disposable shaving-machines whose start-up positions are known.

c) The basic goal in their development is not that the invention should occupy scant space as a disposable razor, but feature multi functions.

d) They are devoid of any hygienic concerns and considerations.

e) A majority of the products is unable to accommodate after-shave fluid.

SUMMARY OF INVENTION

The expansion of transportation means and a reduction in travel costs has brought on the agenda the possibility of making business trip with a shorter duration. In general, preferring air voyage for this type of trips, the people tend to carry cabin-friendly small luggage and bags in order to ward off the frustration of waiting out their baggage at the terminals. By inference, due to the fact that the internal spaces of the underlined bags are limited, the choice of items will have to be selective, restricted at the minimum measurements, while aspiring for an optimum benefit from diversified items. Furthermore, the menace of terror has also imposed significant restraints on the belongings that could be potentially allowed on board the aircraft cabins.

When a randomly selected ordinary disposable shaving-machine, currently available on the market, is placed on a plain surface horizontally, the highest point that could be measured in perpendicular to the plane may not submerge below 25 mm. This height is also reflected on the packaging of the shaving-machines: consequently, the thickness of the thinnest packet of a shaving-machine set ranges above 25 mm.

In a similar manner, the lengths of the shaving-machines, spanning the extent from the edge of their stems up to their tips, varies between 12–15 cm. Taking into account the fact that the width of their shaving heads is concentrated around 4–5 cm, it will be evident that, on business trips undertaken with a small bag, finding a place for the shaving-machine and the accompanying shaving foam and the after-shave, occupying an equally expansive space, will be truly challenging. Thus, the invention measures a maximum thickness of 12 mm, a width of 45 mm and a length of 75 mm, occupying merely 25% of the volume accounted for only by the cover-package of the shaving-machine, among the articles enumerated above; in conclusion, it offers a unique alternative, designed to satisfy the mentioned need in an optimum manner.

On the other hand, the demand for hygienic and single-use products has undergone a noticeable escalation recently, originating from the developed societies and subsequently—spreading to the entire globe. To cite a few examples: vaccination syringes, diapers, menstrual pads, potable water in PET-containers and soft drinks in disposable and non-refundable bottles and cans. It is possible to list several more other examples. The reasons that have created this incessant demand may be attributed to a plethora of factors. However, as their common denominators and foremost constituents, we may specify the following slug-lines:

The incomes of the nations and invariably the wealth of the individuals are steadily increasing.

People with enhanced income are comparably more conscious allocating some of their assets to health and, in particular, to safeguarding health.

As the public demand intensifies for such personal-care products, the R&D activities in a wide field in the health sector also expand, gradually paving the way for a further sophistication and development in the product-spectrum, focusing specifically on augmented practical use and simplified features. Conceivably, the heightened competition drives their prices down, in due course, enabling a wider segment of the society to employ them regularly.

Specifically, in the case of the shaving materials, as a natural instinct of protection against diverse skin diseases, led particularly by AIDS, the dissemination of disposable products has gained a remarkable momentum recently.

Especially the progress from conventional razor to disposable razor blades has to be remarked. However, the current point is not satisfactory. Although they may be explicitly designated as such, there is a widespread tendency to use razor blades more than once. This probability lends credence to the following possibilities, replete with the obvious risks:

For example, is there any guarantee that a razor blade abandoned in a hotel room will not be picked and used by a member of the hotel's cleaning staff?

Who could be entirely certain that a guest at our house has not used the shaving-equipment in our bathroom?

Is it a far-fetched concern that the cleaner, summoned to our home, has trimmed his/her armpits with the razor blade that has been left there, in the open?

Would it not be possible for our children (could be also the guests" children) to try our shaving gadgets just out of curiosity?

Similar questions, as exemplified above, will multiply in due time and, without doubt, will contribute to the increase in the general public's demand for single-use disposable shaving items in an accelerating pace.

When evaluated within the context of the above-specified two main constraints, it becomes perfectly clear that there is a necessity for a product at least meeting the needs specified therein. Therefore, while designing the invention, it is aimed that the invention should at least meet the criteria listed below:

1. It should occupy as small place as possible.
2. It should be easy-to-use and practical.
3. It should conform to hygienic requirements and standards.
4. It should incorporate an after-shave product, in conjunction also with a pressurized shaving-foam and/or cream. In this manner, it should stand out as a complete set such that the user should feel no demand for any other material.
5. It should be for a single-use.
6. Its manufacturing should be simple and economical.
7. As a product that shall be used with confidence and full safety in the hotels and on board the aircraft, it should be provided both with a price and/or gratis.
8. Guests who arrive without the adequate provisions in their possession should not be coerced to use their host's shaving implements.
9. The products should be sold also on the outside vending machines.

Finally, the invention targets to alleviate this prerequisite both in the most practical and exceptionally hygienic way, in a short-term perspective, while, in a medium- and long-term approach, contemplating also to attract virtually all consumers who uphold the tenets of hygiene.

BRIEF DESCRIPTION OF DRAWINGS

The invention will be better understood and objects other than those set forth above will become apparent when consideration is given to the following detailed description thereof. Such description makes reference to the annexed drawings wherein.

DETAILED DESCRIPTION

Figure 1:
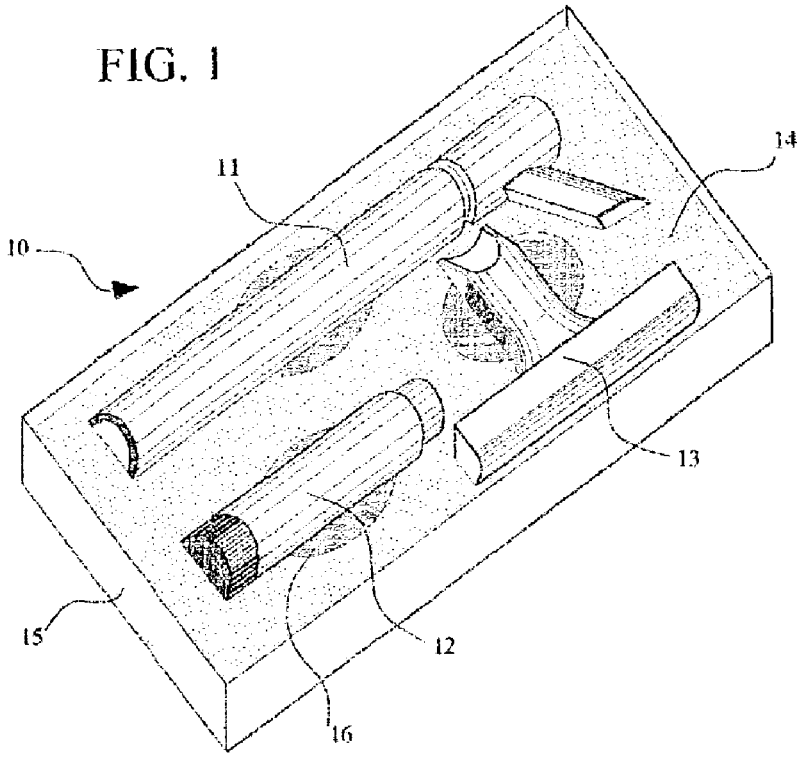
FIG. 1 is a perspective view of the present invention in its initial demounted form.
Figure 2:
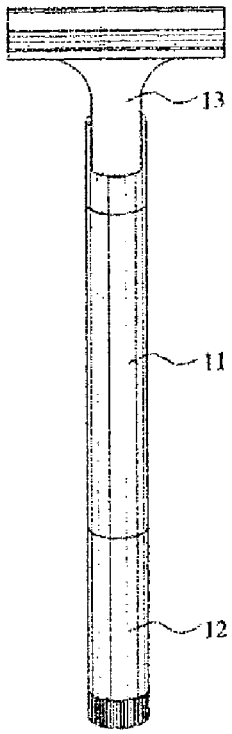
FIG. 2 is a front view of the present invention in mounted form.
Figure 3:
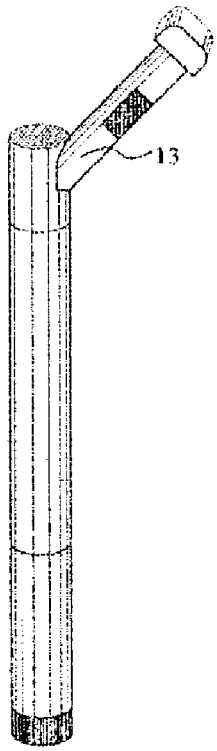
FIG. 3 is a side view of the present invention in mounted form.
Figure 4:
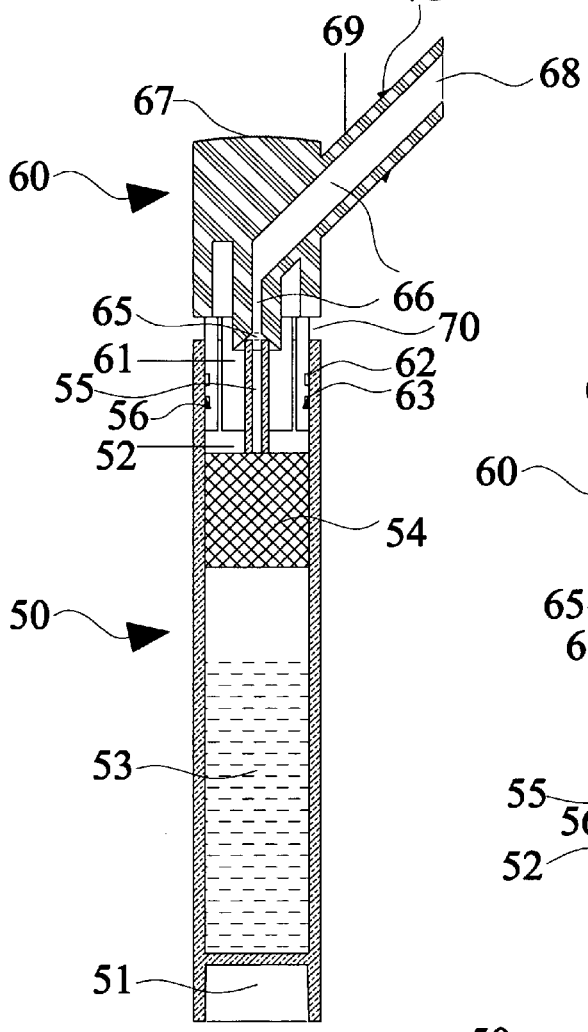
FIG. 4 is a section view of the shaving foam cartridge portion of the present invention.
Figure 5:
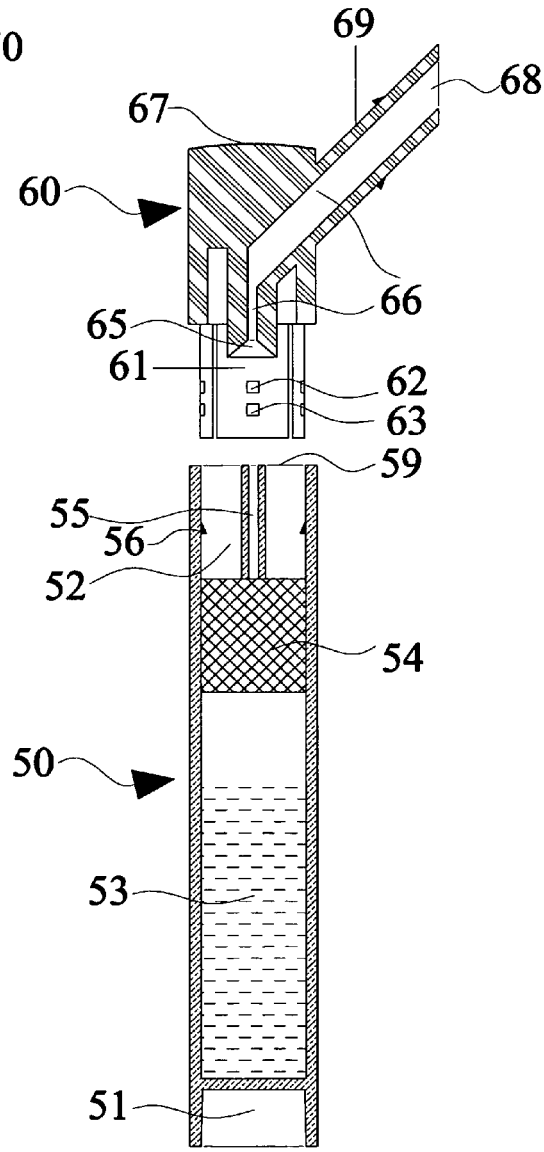
FIG. 5 is a section view of the two sub-parts of the shaving foam cartridge in FIG. 4, illustrated for having a clear view, eliminating overlapping.

In the illustrative embodiments of the invention as shown in FIG. 1, a single-use disposable shaving set generally designated the numeral 10 will be described. The present invention includes a shaving foam cartridge 11, an aftershave liquid cartridge 12 and a blade assembly 13, converting into a shaving machine when inserted into each other; all three placed on a fixing bed 14 which is contained in an open-top box 15. FIGS. 2 and 3 show how they shall look like when mounted.

The fixing-bed 14, preferably made of sponge has grooves 16 at both sides of each part for easy pick-up. Each part should be tightly placed such that, before the box is opened, it should not make any noise when shaken.

Since the invention is designed especially for traveling businessmen, dimensions of each part are very important. The main idea is that the set should be easily portable, even in a man's matchbox pocket. With such an understanding, when placed horizontally, ideally the height of no part should exceed 12 mm so that the height of the box should not exceed 14 mm. Similarly, when the three parts are placed in the box as shown in FIG. 1, the width of the box should not exceed 50 mm and the length 80 mm. The box, whether designed like a matchbox having a drawer or an open top, should be wrapped with cellophane in order to maintain a hygienic environment inside, required to begin at the production process.

The details of each part are illustrated through FIGS. 4 to 7. The cylindrical pressurized chamber 50 of the shaving foam cartridge in FIG. 4 has a cylindrical socket 51 at the bottom, wide and deep enough to exactly fit the closed-top fitting-socket 81 of the aftershave liquid cartridge 12 and a cylindrical socket 52 at the top, wide and deep enough to fit the open-top fitting-socket 61 of the multifunctional cap 60. The details of the shaving foam cartridge may be better understood when they are illustrated in disassembled form as in FIG. 5. There is pressurized foam 53 in the chamber 50 and it is sealed with an aerosol valve 54. There are four triangular elastic catches 56 located horizontally at the same level having equal distance to each other on the inner walls of the socket 52. There are two levels of rectangular holes with a total of eight located horizontally 62, 63 and four vertical openings 64 on the walls of the open-top fitting-socket 61 of the multifunctional cap 60; the openings 64 dividing said walls into four elastic leaves which enable each leaf to easily bend inwards when they pass over the triangular catches 56 while moving downwards. The multifunctional cap 60 and the pressurized chamber 50 are assembled at the factory such that the catches 56 and the bottom level holes 63 meet and hold each other, whereas the funnel-shaped mouth 65 of the passageway 66 just touches and closes the tip of the nozzle 55 of the aerosol valve 54. The catches 56 are used to eliminate removal of the multifunctional cap 60 at the first position. At this position, there exists a distance 70 to go between the multifunctional cap 60 and pressurized chamber 50 which is used to activate the aerosol valve. For this purpose, the multifunctional cap 60 is firmly pressed downwards by pressing on the circular surface 67 which causes the multifunctional cap go down such that the catches 56 leave the lower level holes 63 and catch the upper level holes 62 at the level where the distance 70 is fully closed. At this position, the multifunctional cap 60 and the pressurized chamber 50 are tightly mounted to each other. While pressing, force is applied also on the nozzle 55 of the aerosol valve 54 by the funnel-shape mouth 65 of the passageway 66 at the center of the multifunctional cap, causing said nozzle 55 go downwards and the aerosol valve 54 to open and remain in the open position, thus avoiding the necessity of applying continuous force on circular surface 67. When the aerosol valve is opened, the pressurized foam flows through the valve nozzle and flows through the passageway 66, and finally expels from the mouth 68 of the nozzle 69 of the multifunctional cap. The nozzle 69 of the multifunctional cap 60 has a semi-circular section, wide and long enough to exactly fit into the hollow 93 of the blade assembly 13 and there are catches 71 on its outer surface for a tight mounting with the blade assembly 13.

Figure 6:
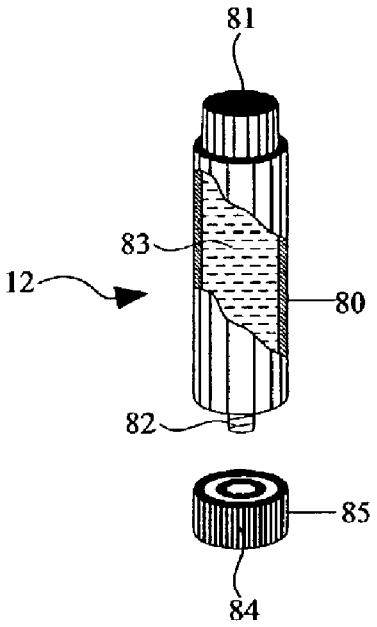
FIG. 6 is a fragmentary perspective view of the aftershave liquid cartridge portion of the present invention.

The aftershave liquid cartridge in FIG. 6 has a cylindrical body 80 being the same diameter with that of the shaving foam cartridge, equipped with a cylindrical fitting-socket 81 at the top that is thick and long enough to exactly fit into the socket 51 of shaving foam cartridge and a cylindrical discharge nozzle 82 at the bottom, defining an interior space 83 with an adequate volume to contain enough after-shave liquid for a single use. There are grooves 84 perpendicularly placed all over the outer surface of the lid 85 for easy removal. The lid is of the same diameter with that of the body and suitable for tightly sealing the liquid contained therein.

Figure 7:
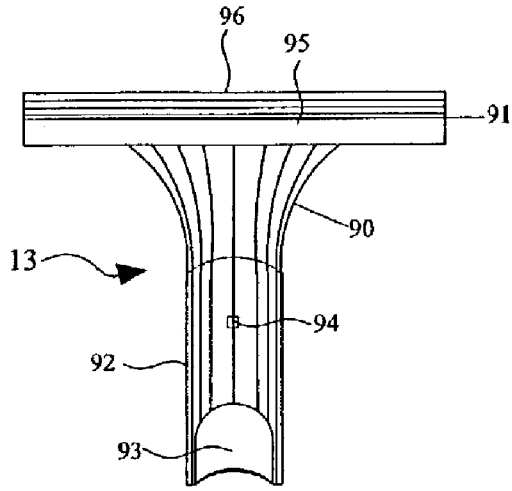
FIG. 7 is a fragmentary top view of the blade assembly portion of the present invention.

The blade assembly in FIG. 7 has a body with a triangular portion 90 having a rectangular conventional shaving head 91 at one edge with at least one blade coupled thereto. There are grooves 92 along the other two edges to seize and facilitate the mounting operation. The interior part of the blade assembly is a hollow 93 in the form of a semi-circle with holes 94 on the walls to fit to the catches on the outer surface of the nozzle of the multifunctional cap of shaving foam cartridge, such that the semi-circular form assures a right mounting with a unique angle whereas the catches are used for a tight and non-removable mount. The blade/blades 95 are protected by a soft nylon film 96 fastened at the edges of shaving head, which can be easily peeled off, with an additional function of preventing injuries.

In FIGS. 8 to 14, a step-by-step illustration is provided on how and in which order the said three parts are mounted to form a shaving machine.

Figure 8:
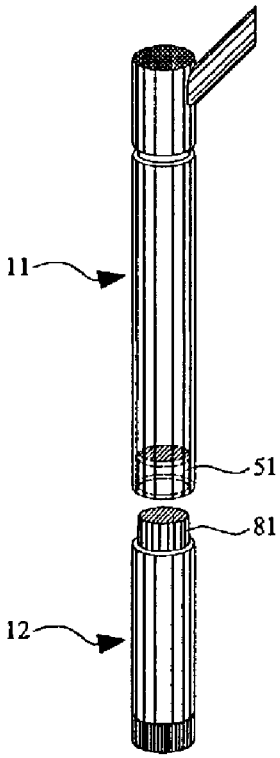
FIG. 8 illustrates how the shaving foam cartridge is mounted on the aftershave liquid cartridge to form a handle.
Figure 9:
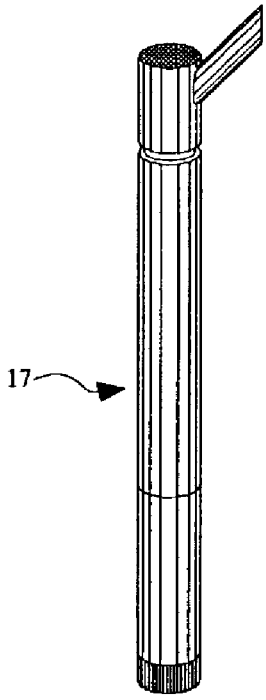
FIG. 9 illustrates how the handle looks like when mounted in FIG. 8.

Firstly, the aftershave cartridge 12 is mounted on the shaving foam cartridge 11 such that the fitting-socket 81 of the aftershave cartridge is inserted tightly into the bottom socket 51 of the shaving foam cartridge as shown in FIG. 8. When mounted, the two parts constitute the handle 1 7 of the shaving machine as illustrated in FIG. 9.

Figure 10:
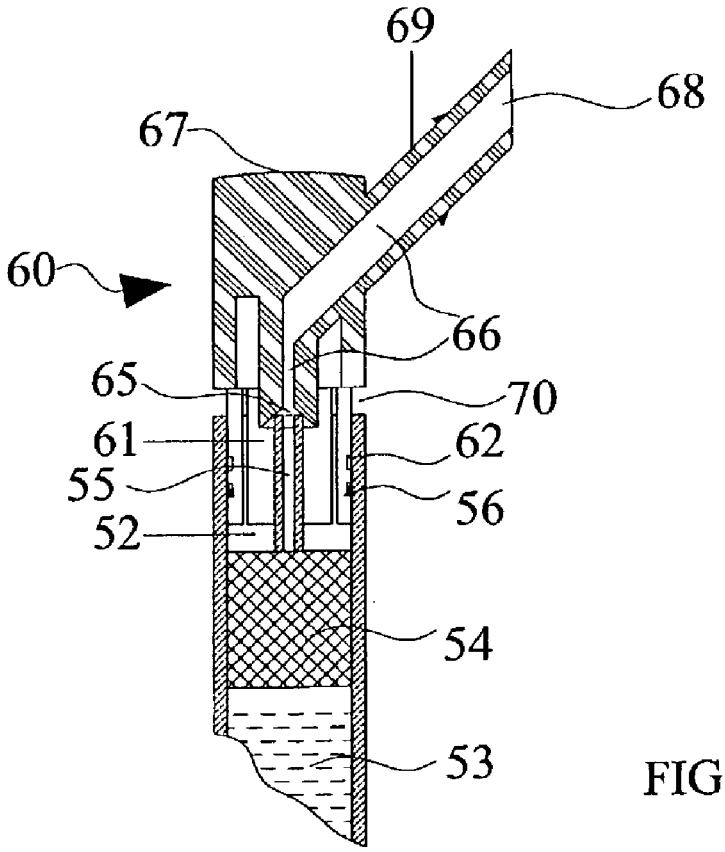
FIG. 10 is a partial section view of the shaving foam cartridge of the present invention showing details of its position before dispensing the shaving foam therein.
Figure 11:
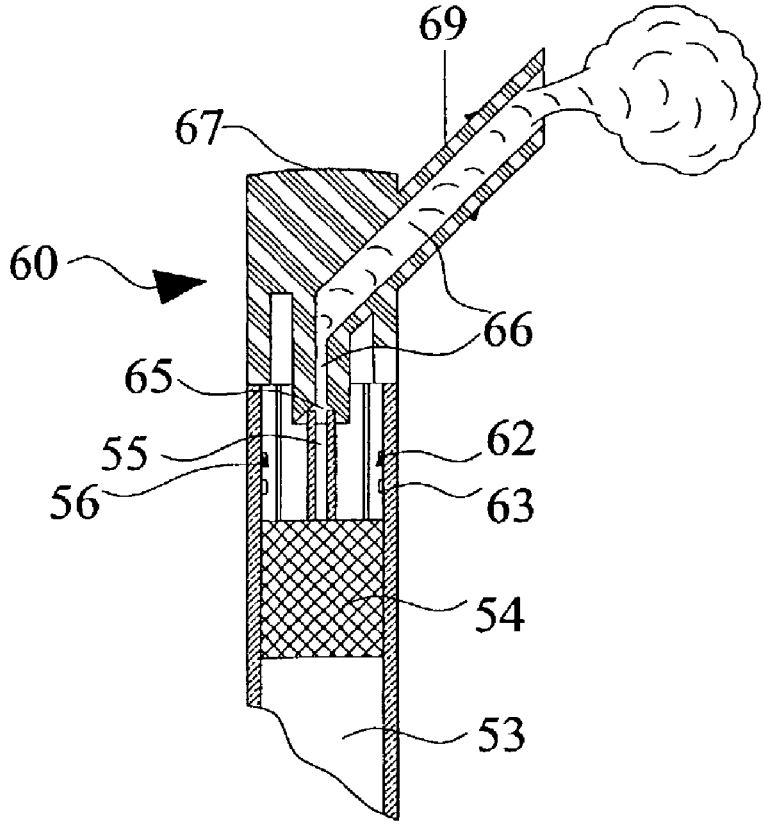
FIG. 11 is a partial section view of the shaving foam cartridge of the present invention showing details of its position after pressing the multifunctional cap in order to dispense the shaving foam.

At this stage, as illustrated in FIGS. 10 and 11, the circular surface 67 of the multifunctional cap 60 at the top of the handle is pressed as far as it goes until a click sound is heard where the catches 56 on the walls of the socket 52 are inter-locked with the upper level rectangular holes 62 placed horizontally on the surface of the open-top fitting-socket 61 irretrievably and holding each other firmly. While pressing, force is applied also on the nozzle 55 of the aerosol valve 54 by the funnel-shape mouth 65 of the passageway 66 at the center of the fitting-socket, causing said nozzle 55 to go downwards and the aerosol valve 54 to open and remain in open position, thus avoiding the necessity to apply continuous force on circular surface 67. Once the aerosol valve 54 is open, the pressurized foam contained in the chamber 53 flows first through the nozzle 55 of the aerosol valve, reaching the passageway 66 of the multifunctional cap 60, finally pouring out of the mouth 68 of the nozzle 69 of the multifunctional cap.

Figure 12:
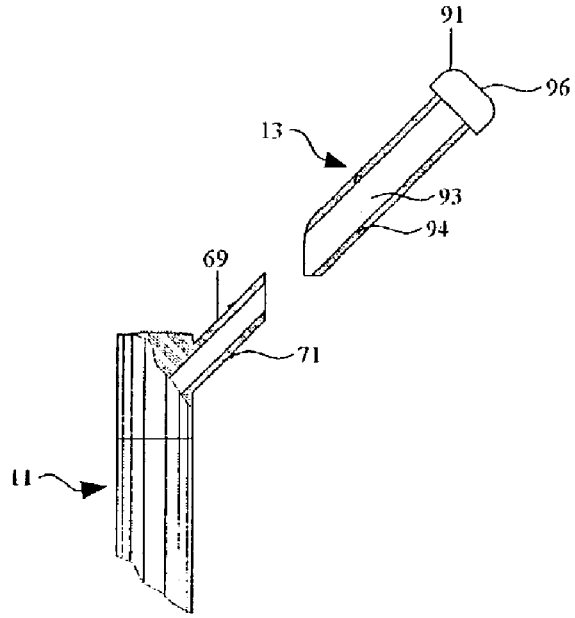
FIG. 12 illustrates how the blade assembly is mounted on the handle to form a shaving machine.

FIG. 12 illustrates how to mount the blade assembly 13 on the handle after the foam is dispensed. At this point, it is expected that the foam is applied to the face. Then, the blade assembly has to be mounted to the handle as shown. Because of the semi-circular form of the nozzle 69 of the multifunctional cap 60 and of the hollow 93 inside the blade assembly, the blade assembly can be mounted to the handle only with a unique angle. The catches 71 located on the outer surface of the nozzle 69 of the multifunctional cap and the holes 94 located on the inner surface of the hollow assure a right and tight mounting whereas preventing their loosening while shaving. Once the blade assembly is tightly secured to the handle, the blade protector 96 stuck on the shaving head 91 is peeled off.

Figure 13:
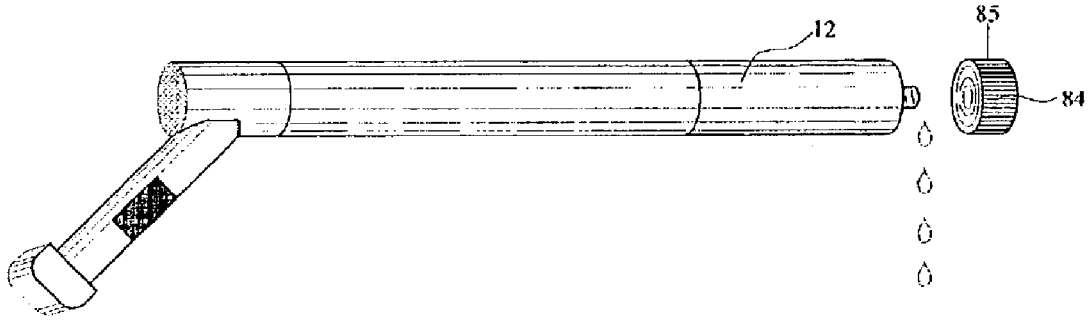
FIG. 13 illustrates the first alternative of facilitating the after-shave liquid contained in the aftershave liquid cartridge of the present invention.
Figure 14:
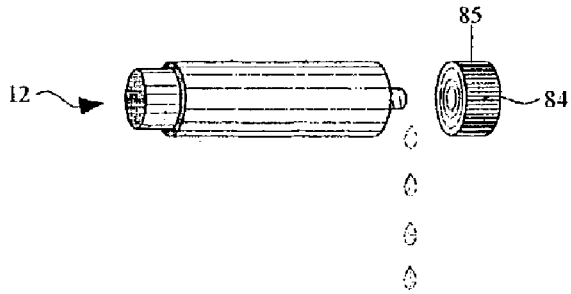
FIG. 14 illustrates the second alternative of facilitating the after-shave liquid contained in the aftershave liquid cartridge of the present invention.

Composed of three main parts, FIGS. 2 and 3 show the shaving machine's general appearance from front and side view after the mounting process is over. Now it can be used for shaving. Following the shaving, the aftershave liquid contained in the aftershave liquid cartridge 12 is poured out by opening the lid 85 that seals it. There may be vertical grooves on the outer surface 84 of the lid 85 enabling an easy turn. For pouring out the aftershave liquid, the aftershave liquid cartridge can be removed from the shaving machine before opening the lid 85 or it may be done without removal as illustrated in FIGS. 13 and 14.

This step finishes the process of mounting and also shaving. In the last step, the used shaving machine is disposed of properly making sure that nobody can use it in view of the risk of an infection.

The preferred embodiment of the invention described above has not to be understood as constrained to the details of illustrations and explanations therein. Also, it is to be understood that the phraseology and terminology employed herein are for the purpose of description and should not be regarded as limiting.

I claim:

1. A shaving set for assembly, comprising:

a shaving blade assembly including a body that extends in a first direction and a shaving head that extends generally perpendicular to the body and is mounted on a first end of the body;

a shaving foam cartridge;

an aftershave cartridge; and means for assembly of the shaving blade assembly, the shaving foam cartridge and the aftershave cartridge into a single unit for shaving; wherein the shaving foam cartridge comprises:

a pressurized chamber to hold pressurized shaving foam, the pressurized chamber having one opening;

an aerosol valve installed in the opening in the pressurized chamber and sealing the chamber, the aerosol valve having a nozzle protruding from a discharge point thereof;

a multifunctional cap having two ends and a side extending between the two ends, wherein the multifunctional cap is mounted at one of its ends to a first end of the pressurized chamber such that it is mounted over the nozzle of the aerosol valve; and a passageway through the multifunctional cap, the passageway extending from the nozzle of the aerosol valve to a discharge nozzle, wherein the discharge nozzle protrudes from the side of the multifunctional cap, the multifunctional cap further including a means for opening the aerosol valve by pressing down on the multifunctional cap;

wherein the means for assembly includes a means for secure attachment of a second end of the body of the shaving blade assembly to the discharge nozzle such that the body extends generally in the direction of the discharge nozzle, and wherein the means for assembly further includes means for secure attachment of a second end of the pressurized chamber to a top of the aftershave cartridge.

2. A shaving set according to claim 1, in which the unassembled parts of the shaving set are located in a box designed to accept the parts when unassembled.

3. A shaving set according to claim 2, in which the box contains a fixing bed with spaces to accept each part and recessions for being located around each part to enable easy removal of the associated part.

4. A shaving set according to claim 3, in which the box with the parts installed does not exceed 80 mm (L)×50 mm (W)×14 mm (H).

5. A shaving set according to claim 1, in which the body includes a triangular portion and the shaving blade assembly further comprises:

the shaving head mounted on the broadest part of the triangular portion, and the shaving head having at least one blade;

wherein the means for secure attachment of the discharge nozzle to the body of the shaving blade assembly includes a hollow opening in the second end of the body opposite to the first end to cover the discharge nozzle protruding from the shaving foam cartridge.

6. A shaving set according to claim 5, further comprising grooves on an outside surface of the triangular body to enable secure gripping.

7. A shaving set according to claim 5, further comprising a removable protective film covering the shaving head and protecting the blade.

8. A shaving set according to claim 1, further comprising a means to secure and maintain the aerosol valve in an open position.

9. A shaving set according to claim 1, the means for opening the aerosol valve comprising a funnel shaped mouth at one end of the passageway in the multifunctional cap enclosing the nozzle of the aerosol valve.

10. A shaving set according to claim 1, in which the discharge nozzle protrudes from the side of the multifunctional cap at an angle of 135°.

11. A shaving set according to claim 1, in which the aftershave cartridge comprises:

an inner space and an opening at one end;

the inner space for containing aftershave;

a lid to close the opening of the aftershave cartridge.

12. A shaving set according to claim 11, further comprising grooves on an outer surface of the lid to enable secure gripping.

* * * * *